United States Patent [19]

Rathmayr

[11] 4,244,520

[45] Jan. 13, 1981

[54] FUEL INJECTION DEVICE FOR FUEL INJECTION INTERNAL COMBUSTION ENGINES

[75] Inventor: Heinz Rathmayr, Hallein near Salzburg, Austria

[73] Assignee: Friedmann & Maier Aktiengesellschaft, Hallein near Salzburg, Austria

[21] Appl. No.: 23,253

[22] Filed: Mar. 23, 1979

[30] Foreign Application Priority Data

Mar. 29, 1978 [AT] Austria ..... 2207/78

[51] Int. Cl.[3] ..... F02M 47/02

[52] U.S. Cl. ..... 239/88

[58] Field of Search ..... 239/88–92

[56] References Cited

U.S. PATENT DOCUMENTS

| | | | |
|---|---|---|---|
| 2,571,501 | 10/1951 | Truxell | 239/90 X |
| 2,793,076 | 5/1957 | Brehmer | 239/90 |
| 3,409,225 | 11/1968 | Maddalozzo | 239/91 X |
| 4,158,442 | 6/1979 | Rathmayr | 239/88 |

*Primary Examiner*—Richard A. Schacher

*Attorney, Agent, or Firm*—Cushman, Darby & Cushman

[57] ABSTRACT

The fuel injection device is designed as a compact module. The fuel is to be supplied through a bore of the housing of the fuel injection internal combustion engine. For accommodating the fuel filter in a protected manner without detracting from the mechanical strength of the housing, the fuel supply conduit opens into a space located at the side of the flange directed toward the nozzle, noting that the flange has at least one axial opening connecting the space located at the side of the flange directed toward the nozzle with the suction space of the pump piston. The fuel filter is arranged between the space located at the side of the flange directed toward the nozzle and the suction space.

7 Claims, 4 Drawing Figures

Figure 3:
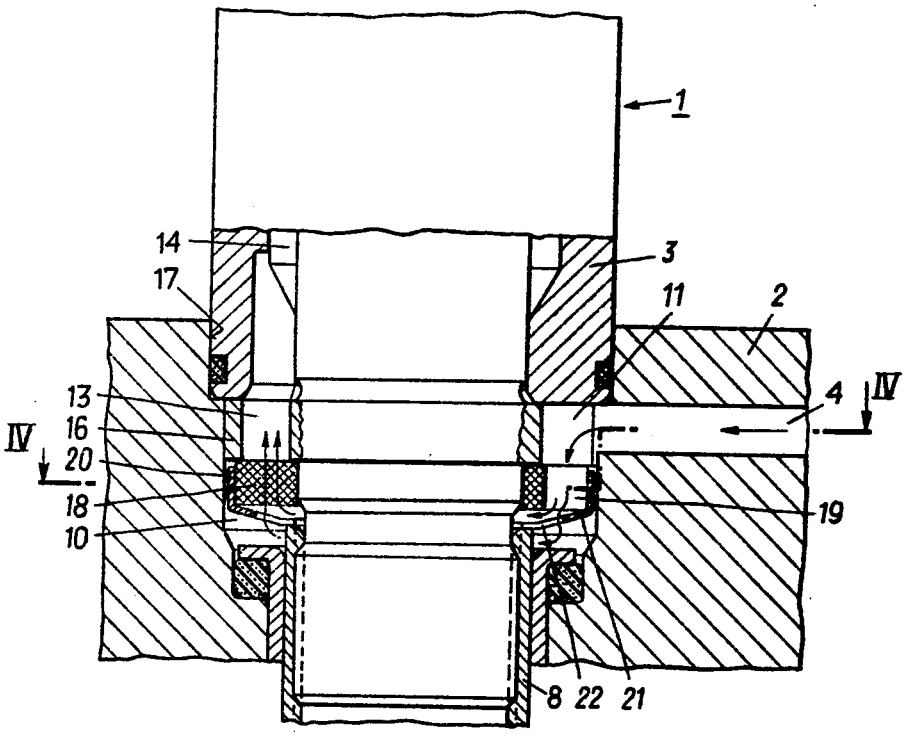

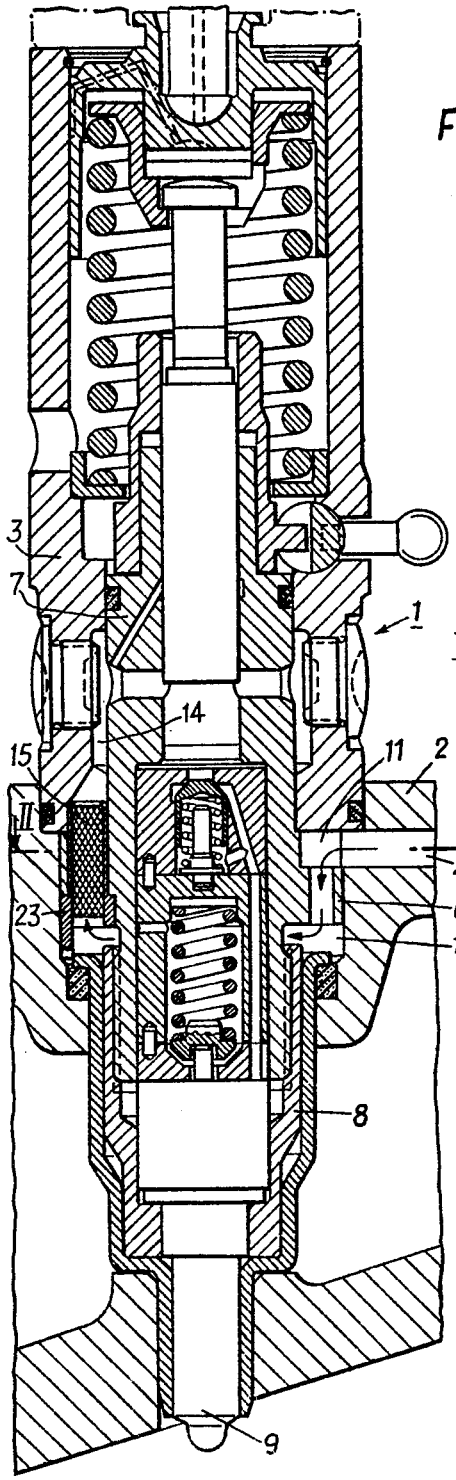
FIG.1
FIG.2
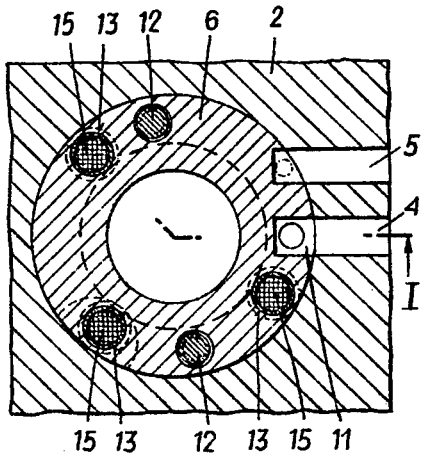

FUEL INJECTION DEVICE FOR FUEL INJECTION INTERNAL COMBUSTION ENGINES

The object of the present invention is a fuel injection device for fuel injection internal combustion engines in which the fuel injection pump and the injection nozzle provided with a spring-loaded nozzle needle form a unit to be put into the wall delimiting the cylinder of the fuel injection internal combustion engine, said fuel injection device comprising a pump piston bushing, a pump piston and a fuel injection pump housing enclosing the pump piston bushing, the return-spring acting on the pump piston and the regulating bushing acting on the pump piston and being adapted to be clamped with the housing of the fuel injection internal combustion engine by means of paraxial clamp bolts, noting that the fuel injection nozzle is clamped by means of a clamping nut to a constructional part comprising the pump piston bushing with interposition of a pressure valve housing and of a housing enclosing the nozzle needle spring, that the fuel injection pump housing is adapted to be clamped to the housing of the fuel injection internal combustion engine with interposition of the constructional part comprising the pump piston bushing, that the fuel injection pump housing is seated against a flange of the constructional part comprising the pump piston bushing and that the fuel injection pump housing is securely maintained in a defined rotational position relative to the constructional part comprising the pump piston bushing and is connected with the latter in a manner sufficient for transport and storage only, preferably by means of at least one excentrically arranged screw. Such a construction results in a space saving fuel injection device which can be stored as a single unit and can be installed in fuel injection internal combustion engines in a simple manner. This space saving construction also provides the possibility to replace a damaged fuel injection device, so that repair work can easily be performed.

In fuel injection devices of the kind described it is usual practice to supply the fluel to the working space of the fuel injection pump piston via a bore provided in the housing of the fuel injection internal combustion engine. To avoid operation disturbances by contaminations contained in the fuel it is convenient to provide a fuel filter which is to be arranged immediately upstream of the fuel injection device. In usual fuel injection pumps, in which a fuel supply conduit formed of a tube is connected to the fuel injection pump housing, such a fuel filter can be provided at the connection point where the fuel supply conduit is connected to the fuel injection pump housing. In the fuel injection device of the kind mentioned above, in which the fuel supply conduit is formed by a bore provided within the housing of the fuel injection internal combustion engine, it is, however, quite difficult to arrange such a fuel filter. If such a filter is to be arranged within the fuel supply conduit, a complicated system of bores within the housing of the fuel injection internal combustion engine is required because a filter provided within the fuel supply path and at the housing of the fuel injection internal combustion engine must have a supply bore and an outlet bore for the fuel. Such a system of bores mechanically weakens the housing of the fuel injection internal combustion engine and a constructional part, i.e. a filter, arranged at the outer side of the fuel injection internal combustion engine is quite exposed to become damaged.

The present invention now aims at avoiding the mentioned drawbacks in an arrangement of the kind defined and essentially consists in that the fuel supply conduit formed of a bore within the housing of the fuel injection internal combustion engine opens into a space located at the side of the flange directed toward the nozzle, that the flange has at least one axial opening connecting the space located at the side of the flange directed toward the nozzle with the suction space of the pump piston and that a fuel filter is arranged between the space located at the side of the flange directed toward the nozzle and the suction space. In this manner, the fuel filter is wholly included within the fuel injection device. One can do without a separate constructional part and the fuel injection device can be installed into the housing of the fuel injection internal combustion engine together with the filter. This is of particular advantage when replacing the fuel injection device, because such replacement is effected in a garage or in a work shop with personnel not specially skilled with fuel injection pumps. The whole unit of the fuel injection device already containing the filter can be repaired in a specialized workshop where simultaneously the filter can be given the required service.

According to a preferred embodiment of the invention, the fuel filter can be inserted into the axial opening of the flange. In this case and according to the invention, the axial openings of the flange can be formed of a number of bores into which cylindrical filter cartridges are inserted, preferably press-fitted. In this manner, the flange, which is provided at any rate and which provides sufficient space for such axial bores, is made use of for accommodating the filter elements or filter cartridges, respectively. Such arrangement of such filter cartridges provides the advantage that, even on removal of the fuel injection device by non-skilled personnel for the purpose of cleaning the nozzle, the filter elements, which are protected within the cartridges, cannot become damaged and that the fuel path downstream of the filter cartridge cannot become contaminated.

According to another advantageous embodiment of the invention the filter can also be formed as a filter ring engaging the side of the flange which is directed toward the nozzle. In this case and according to the invention, the filter ring can be housed in an annular cage made of sheet material or the like and having its bottom provided with passage openings and being resiliently supported in axial direction on a rest, preferably the clamping nut. The filter ring is resiliently pressed against the flange by the annular cage and thus sealingly engages the flange. By supporting the filter ring against the clamping nut, there results the advantage that the filter ring can be removed after having removed the clamping nut but remains connected to the fuel injection device and forms a unit therewith during storage, mounting and disassembly. In this case and according to the invention, the bottom of the cage can be formed of individual spring tongues inwardly extending along a cone surface and resiliently contacting the clamping nut or the like. By arranging the spring tongues along a conical surface there results the advantage that the total filter surface is made use of for filtering the fuel.

In both embodiments described, the arrangement is conveniently such that the fuel supply conduit opens into a recess provided at the outermost border of the flange, said recess being open in direction to the side of the flange directed toward the nozzle, noting that a filter ring, if provided, equally has a recess at the location of the recess at the outermost border of the flange. The flange is the only part of the constructional part comprising the pump piston bushing which immediately contacts the housing of the fuel injection internal combustion engine in mounted condition of the fuel injection device, because the fuel injection pump housing is supported against this flange. In that initially defined embodiment in which no fuel filter is provided, the bore forming the fuel supply conduit within the housing of the fuel injection internal combustion engine is thus opening into a recess provided at the outermost border of the flange, said recess being open toward the suction space of the pump piston and being closed in direction to the side of the flange which is directed toward the nozzle. In view of the bore forming the fuel supply conduit is also opening, according to the invention, into such a recess provided at the border of the flange but is open in direction to the side of the flange directed to the nozzle, it becomes possible to feed the fuel through the filter without the necessity to change the position of the bore forming the fuel supply conduit and being provided within the housing of the fuel injection internal combustion engine. Such a construction provides the advantage that the inventive fuel injection device, which is provided with an integral filter, can without further be installed within the housing of the fuel injection internal combustion engine in place of a fuel injection device of the type initially defined.

The invention is further illustrated with reference to the drawing showing embodiments of the invention.

Figure 4:
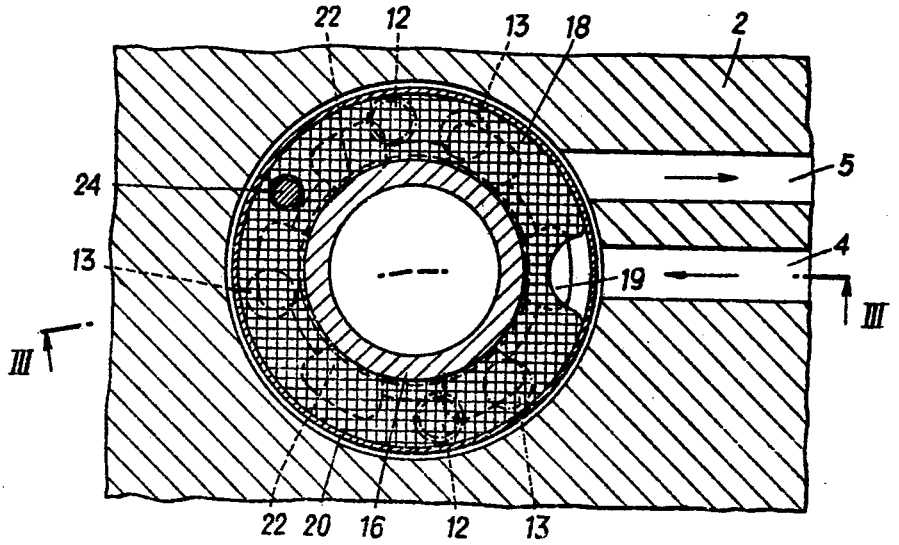

In the drawing,

FIGS. 1 and 2 show an embodiment in which the filter is formed of filter cartridges inserted into the flange, noting that FIG. 1 is a section along line I—I of FIG. 2 and FIG. 2 is a section along line II—II of FIG. 1, and FIGS. 3 and 4 show an embodiment having an annular filter, noting that FIG. 3 is a section along line III—III of FIG. IV and FIG. IV is a section along line IV—IV of FIG. 3.

In the embodiment of FIGS. 1 and 2 1 is a fuel injection device and 2 is the housing of the fuel injection internal combustion engine into which is mounted the fuel injection device 1. 3 is the housing of the fuel injection device. 4 is the fuel supply bore provided in housing 2 and 5 is the fuel return bore. 6 is a flange which forms one single part together with the pump piston bushing 7. The fuel injection device is clamped to the housing 2 of the fuel injection internal combustion engine by means of axial clamping screws which engage the fuel injection pump housing 3. 8 is a clamping nut by means of which the fuel injection nozzle 9 is clamped to the fuel injection pump housing 3. 12 is a screw by means of which the flange 6 is screwedly connected to the fuel injection pump housing 3 so that the pump piston bushing 7 remains connected with the housing during storage.

At the side of the flange 6 directed toward the nozzle 9, there is provided a free annular space 10. The flange 6 is provided at its outermost border with a recess 11 through which fuel flows from the fuel supply bore 4 into the annular space 10. A plurality of bores 13 is provided in flange 6, said bores 13 connecting the annular space 10 with the suction space 14 of the fuel injection pump. Filter cartridges 15 formed of containers of sheet material filled with filter material are fitted into these bores 13. 23 is a socket for the filter cartridge 15.

In FIG. 3 there is only shown the middle portion of the fuel injection device 1 which, however, corresponds to the embodiment shown in FIG. 1. The section shown in FIG. 4 is made below the flange, but the bores located within the housing of the fuel injection internal combustion engine as well as the passage openings provided within the flange are located above said section are shown in dashed-dotted lines.

In the embodiment according to FIGS. 3 and 4, the flange 16 has a smaller height than the flange 6 shown in FIGS. 1 and 2. The receiving bore 17 within the housing 2 of the fuel injection internal combustion engine is designed as in the embodiment shown in FIGS. 1 and 2. Thus, the annular space 10 located at the side of the flange directed toward the nozzle has a greater height than the annular space 10 in FIGS. 1 and 2. The fuel flows from the fuel supply bore 4, which is shown with dashed lines in FIG. 4, again via a recess 11 provided at the border of the flange 16 into the annular space 10. Again, the flange 16 is provided with axial passage openings 13 via which the annular space 10 is in connection with the suction space 14 of the fuel injection pump.

In this embodiment, an annular filter 18 is arranged within the annular space 10 and is contacting the side of the flange 16 directed toward the nozzle so that fuel flowing through the passage opening 13 becomes filtered. In alignment with the recess 11 provided within the flange 16 a recess 19 is provided in the filter so that fuel can unobstructedly flow into the annular space 10. The annular filter 18 is held within an annular cage 20 of sheet material, the bottom 21 of which is provided with spring tongues 22 resiliently supported against the clamping nut 8. In this manner, the annular filter 18 is pressed against the flange 16 and is combined to a single unit with the fuel injection device 1. The filter 18 can be removed by unscrewing the clamping nut 8.

24 is a retaining pin which maintains the annular filter 18 in the correct angular position relative to the flange 16 so that the recess 19 within filter 18 is kept in alignment with the recess 11 provided within flange 16.

What is claimed is:

1. In a fuel injection device for an internal combustion engine: an injection pump unit having a longitudinal axis and including an internal pump suction space, an internal longitudinally movable pump piston, and at one end a fuel injection nozzle through which fuel may be injected from said pump suction space into an engine cylinder, said pump unit having an annular flange intermediate its ends which fits into a recess in the engine, said flange in conjunction with the wall of said recess forming a fuel-containing space which is located on the nozzle-side of said flange and which is located so as to receive fuel from a fuel supply bore in the engine housing communicating with the recess in the engine housing; at least one axial opening in said flange placing said fuel space in communication with said pump suction space; and a fuel filter associated with said opening so that fuel flows in an axial direction from said fuel space through said fuel filter to said pump suction space.

2. A fuel injection device as in claim 1 wherein there are a plurality of axial openings in said flange and wherein a fuel filter is press-fitted into each opening.

3. A fuel injection device as in claim 1 wherein said fuel filter is ring-shaped and is in engagement with the nozzle-side of said flange.

4. A fuel injection device as in claim 3 wherein said fuel filter is disposed within an annular cage having a bottom provided with fuel passages, and means resiliently supporting said cage toward said flange.

5. A fuel injection device as in claim 4 wherein said resilient supporting means includes spring tongues formed by the bottom of said cage, said tongues extending radially inwardly and downwardly.

6. A fuel injection device as in claim 1 wherein said flange has a recess in its outer periphery disposed adjacent the end of the fuel supply conduit.

7. A fuel injection device as in claim 1 wherein said fuel filter is ring-shaped and is in engagement with the nozzle-side of said flange, the peripheries of said flange and said fuel filter having recesses therein disposed adjacent the end of the fuel supply conduit.

* * * * *